US010304620B2

(12) United States Patent
Lee et al.

(10) Patent No.: US 10,304,620 B2
(45) Date of Patent: May 28, 2019

(54) THIN FILM TYPE INDUCTOR AND METHOD OF MANUFACTURING THE SAME

(71) Applicant: Samsung Electro-Mechanics Co., Ltd., Suwon-si (KR)

(72) Inventors: Yong-Sam Lee, Yongin-si (KR); Youn-Soo Seo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 14/992,351

(22) Filed: Jan. 11, 2016

(65) Prior Publication Data

US 2016/0276094 A1 Sep. 22, 2016

(30) Foreign Application Priority Data

Mar. 16, 2015 (KR) ..... 10-2015-0035936

(51) Int. Cl.

| | |
|---|---|
| ***H01F 17/00*** | (2006.01) |
| ***H01F 27/28*** | (2006.01) |
| ***H01F 27/32*** | (2006.01) |
| ***H01F 17/04*** | (2006.01) |
| ***H01F 27/29*** | (2006.01) |
| ***H01F 41/04*** | (2006.01) |

(52) U.S. Cl.

CPC ..... *H01F 27/324* (2013.01); *H01F 17/0013* (2013.01); *H01F 17/04* (2013.01); *H01F 27/292* (2013.01); *H01F 41/046* (2013.01); *H01F 2017/0066* (2013.01)

(58) Field of Classification Search

CPC ..... H01F 17/0013; H01F 2027/2809; H01F 2017/002

See application file for complete search history.

(56) References Cited

U.S. PATENT DOCUMENTS

| | | | | |
|---|---|---|---|---|
| 4,416,056 A * | 11/1983 | Takahashi | G11B 5/313 29/602.1 |
| 6,996,892 B1 * | 2/2006 | Dening | H01F 17/0013 29/602.1 |
| 2004/0164835 A1 * | 8/2004 | Shoji | H01F 17/0013 336/200 |
| 2005/0184848 A1 * | 8/2005 | Yoshida | H01F 17/0013 336/223 |

(Continued)

FOREIGN PATENT DOCUMENTS

| | | | |
|---|---|---|---|
| JP | H10241983 A * | 9/1998 | H01F 17/00 |
| JP | 2014080674 A * | 5/2014 | C25D 3/22 |

OTHER PUBLICATIONS

JPH10241983A, Machine Translation, Sep. 1998.*

*Primary Examiner* — Elvin G Enad
*Assistant Examiner* — Malcolm Barnes
(74) *Attorney, Agent, or Firm* — NSIP Law

(57) ABSTRACT

Disclosed is an inductor and a method of manufacturing the same. The inductor may include a core insulating layer, a coil including at least one coil pattern formed on an upper part of the core insulating layer, at least one coil pattern formed on a lower part of the core insulating layer, and a through via configured to electrically connect the at least one coil pattern on the upper part and the lower part, and an insulating layer formed on the upper part and the lower part of the core insulating layer, the insulating layer embedding the coil.

15 Claims, 16 Drawing Sheets

(56) References Cited

U.S. PATENT DOCUMENTS

2006/0214759 A1* 9/2006 Kawarai ..... H01F 17/0006
336/200
2011/0140564 A1* 6/2011 Nomura ..... H01F 41/041
310/208
2011/0310579 A1* 12/2011 Smeys ..... H01F 17/0013
361/782
2012/0168220 A1* 7/2012 Lee ..... H05K 3/429
174/264
2012/0212919 A1* 8/2012 Mano ..... H01F 17/0033
361/782
2013/0162382 A1* 6/2013 Cha ..... H01F 27/29
336/83
2013/0222101 A1* 8/2013 Ito ..... H01F 17/04
336/83
2013/0249664 A1* 9/2013 Tonoyama ..... H01F 41/04
336/200
2013/0278374 A1* 10/2013 Thorslund ..... H01F 27/2804
336/200
2013/0341758 A1* 12/2013 Lee ..... H01L 28/10
257/531
2014/0034373 A1* 2/2014 Yoshikawa ..... H01F 5/003
336/200
2015/0035640 A1* 2/2015 Wang ..... H01F 17/0006
336/200
2016/0078998 A1* 3/2016 Park ..... H01F 17/0013
336/105

* cited by examiner

THIN FILM TYPE INDUCTOR AND METHOD OF MANUFACTURING THE SAME

CROSS REFERENCE TO RELATED APPLICATION(S)

This application claims the benefit under 35 USC § 119(a) of Korean Patent Application No. 10-2015-0035936, filed on Mar. 16, 2015 in the Korean Intellectual Property Office, the entire disclosure of which is incorporated herein by reference for all purposes.

BACKGROUND

1. Field

The following description relates to an inductor and a method of manufacturing the same.

2. Description of Related Art

With the development of electronic devices with smaller sizes, demands for the miniaturization of electronic components has increased. This, in turn, has increased the consideration of electrical, thermal, and mechanical stability in electronic materials. An inductor, a main passive element constituting an electronic circuit together with a resistor and a capacitor, is used in electronic components to remove noises or constituting LC resonance circuits.

As the electronic device is miniaturized and becomes highly efficient, a demand for the efficiency and miniaturization of the inductor has increased.

The inductor may be classified into various types, such as, for example, a multilayered type formed by laminating a coil pattern-printed sheet, a winding type formed by winding a conductive wire such as copper in a coil type, and a thin film type formed by plating. The thin film type inductor is designed to increase a core area and a coil area to improve inductance properties.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide an inductor with improved inductance properties and a method of manufacturing the same.

In one general aspect, there is provided an inductor including a core insulating layer, a coil including at least one coil pattern formed on an upper part of the core insulating layer, at least one coil pattern formed on a lower part of the core insulating layer, and a through via configured to electrically connect the at least one coil pattern on the upper part and the lower part, and an insulating layer formed on the upper part and the lower part of the core insulating layer, the insulating layer embedding the coil.

The inductor may include a leadline embedded in the insulating layer to adhere to the coil.

The leadlines may be formed on each of the upper part and the lower part of the core insulating layer.

The coil pattern may include a first coil pattern formed on the core insulating layer, and a second coil pattern formed on the first coil pattern, wherein a diameter of a lower surface of the second coil pattern may be smaller than a diameter of an upper surface of the first coil pattern.

The coil pattern may include a first coil pattern formed on the core insulating layer, and a second coil pattern formed on the first coil pattern, wherein a diameter of a lower surface of the second coil pattern may be same as a diameter of an upper surface of the first coil pattern.

The inductor may include a connection pattern formed on an upper surface and a lower surface of the through via to adhere to the coil pattern.

The inductor may include a magnetic material layer embedded on the insulating layer and the coil.

The inductor may include an external electrode configured to cover a part of the magnetic material layer and to be electrically connected with the coil.

The second coil may include more than one layers.

The through via may be formed in a hourglass shape, and a diameter of the through via at the upper part may be greater than a diameter of the through via at a point between the upper part and the lower part.

The through via may be formed in a hourglass shape, and a diameter of the through via at the lower part may be greater than a diameter of the through via at a point between the upper part and the lower part.

The diameter of the through via may decrease from the lower part and the upper part to a point between the upper part and the lower part.

According to another aspect, there is provide a method for manufacturing an inductor including forming a through via to pass through a core insulating layer, forming a first coil pattern on an upper part and a lower part of the core insulating layer, the first coil pattern on the upper part and the first coil pattern on the lower part being electrically connected by the through via, forming an insulating layer on the upper part and the lower part of the core insulating layer, and forming a second coil pattern on the upper surface of the first coil pattern, the second coil pattern passing through the insulating layer.

The method may include forming a leadline to adhere with the first coil pattern or the second coil pattern.

The leadlines may be formed on each of the upper part and the lower part of the core insulating layer.

A lower surface of the second coil pattern may be formed to have a smaller diameter than an upper surface of the first coil pattern.

A lower surface of the second coil pattern may be formed to have a same diameter as a upper surface of the first coil pattern.

The method may include forming a connection pattern on an upper surface and a lower surface of the through via to adhere to the first coil pattern.

The method may include repeating the step for forming an insulating layer and the step for forming a second coil pattern to stack a plurality of the second coil patterns on the first coil pattern.

The method may include forming a magnetic material layer on the insulating layer and the second coil pattern.

The method may include disposing an external electrode configured to cover a part of the magnetic material layer and to be electrically connected with the first coil pattern or the second coil pattern.

Other features and aspects will be apparent from the following detailed description, the drawings, and the claims.

Figure 1:
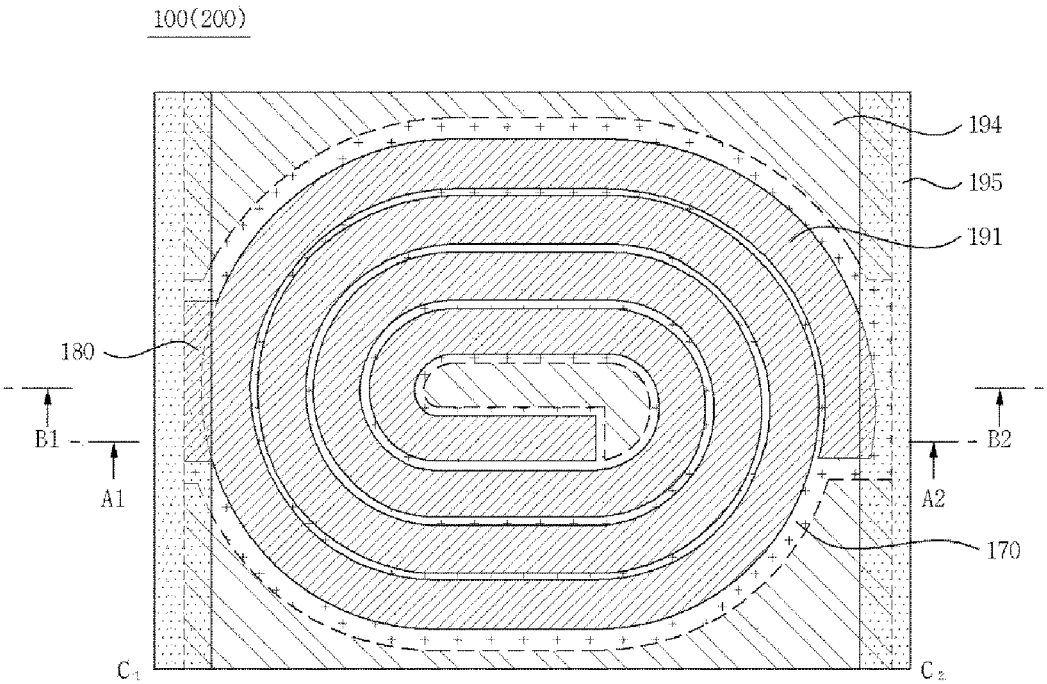
FIG. 1 to FIG. 4 are diagrams illustrating examples of an inductor.

Throughout the drawings and the detailed description, unless otherwise described or provided, the same drawing reference numerals refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations is described as an example; the sequence of operations is not limited to that set forth herein and may be changed as is known in the art, with the exception of steps and/or operations that necessarily occur in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure is thorough, complete, and conveys the full scope of the disclosure to one of ordinary skill in the art.

In descriptions of components of the disclosure, the same reference numerals are used to designate the same or similar components, regardless of the figure number. Throughout the description of the present disclosure, when describing a certain technology is determined to evade the point of the present disclosure, the pertinent detailed description will be omitted. It will be understood that, although the terms "first," "second," etc. may be used herein to describe various elements, these elements should not be limited by these terms. These terms are only used to distinguish one element from another.

FIG. 1 to FIG. 4 are diagrams illustrating examples of an inductor.

Figure 2:
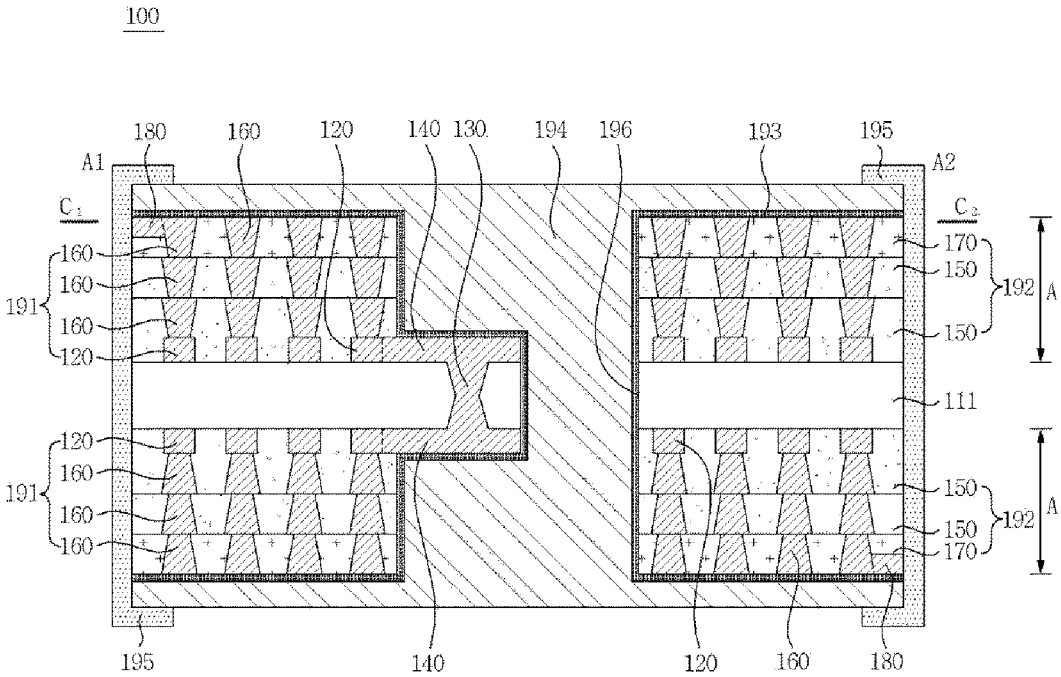
Figure 3:
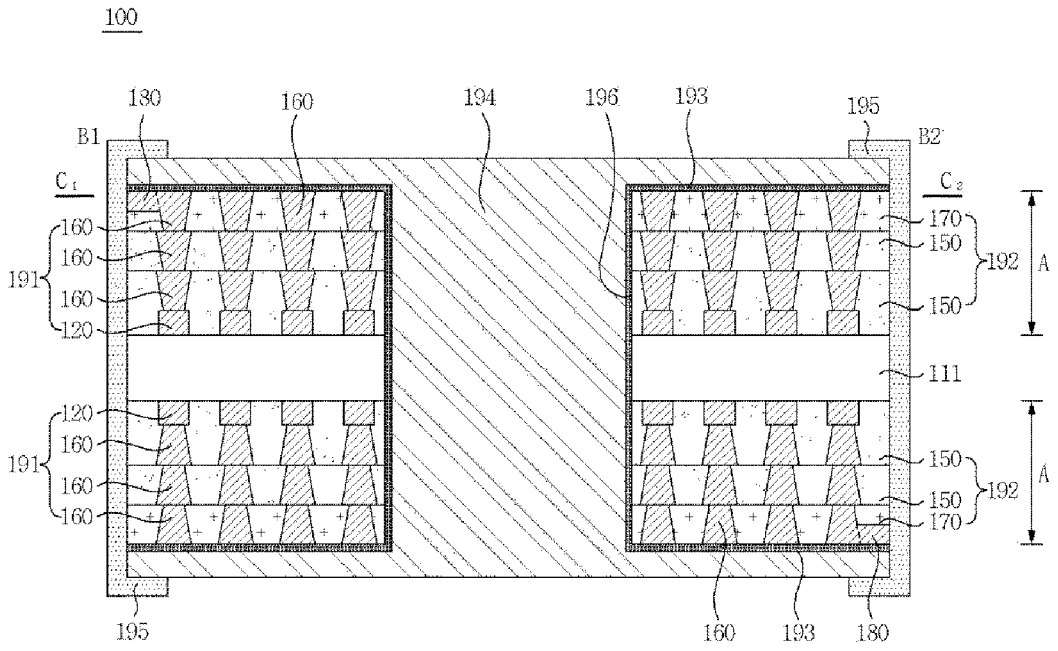
Figure 4:
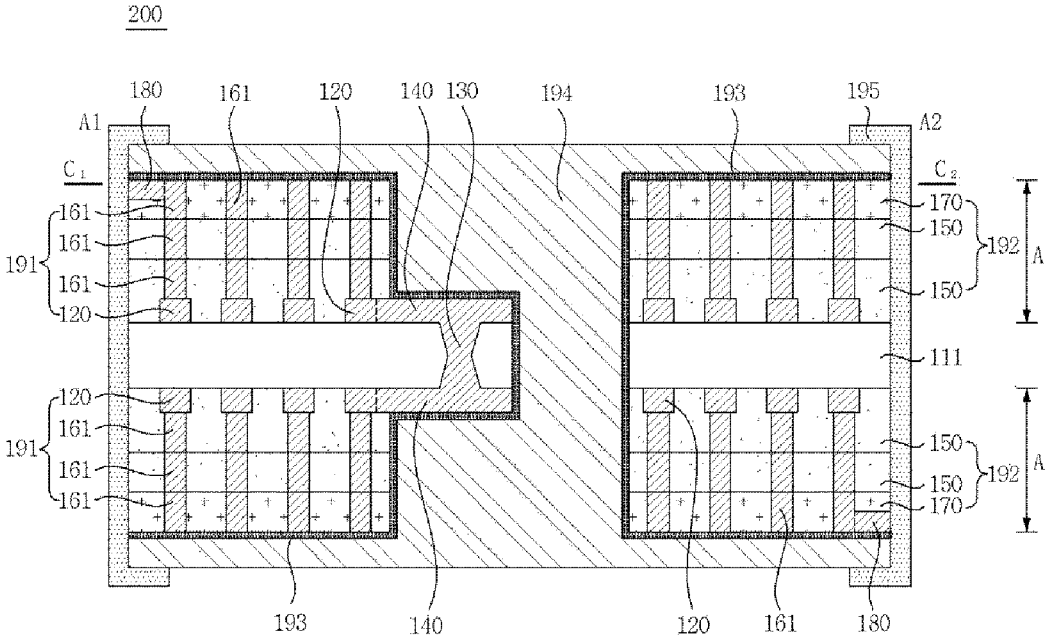

FIG. 1 is a diagram illustrating an example of an inductor 100, 200 and is a C1-C2 sectional view of FIG. 2 to FIG. 4. FIG. 2 is a diagram illustrating an example of an inductor 100 and an A1-A2 sectional view of the inductor 100 of FIG. 1. FIG. 3 is a diagram illustrating an example of an inductor 100 and a B1-B2 sectional view of the inductor 100 of FIG. 1. FIG. 4 is a diagram illustrating an example of an inductor 200 and an A1-A2 sectional view of the inductor 200 of FIG. 1

The inductor 100 will be explained with reference to FIG. 1 to FIG. 3.

In an example, the inductor 100 may include a core insulating layer 111, a through via 130, a coil 191, an insulating layer 192, a leadline 180, a protection layer 193, a magnetic material layer 194, and an external electrode 195.

The core insulating layer 111 may be formed of any resin which is used as a core insulating layer material for printed circuit boards. In an example, the core insulating layer 111 may be formed of an epoxy resin, such as, for example, prepreg, ABF (Ajinomoto Build up Film), FR-4, and BT (Bismaleimide Triazine).

The coil 191 may include a through via 130, a connection pattern 140, a first coil pattern 120, and a second coil pattern 160.

The through via 130 may be formed to pass through the core insulating layer 111. In an example, the through via 130 may be formed in a hourglass shape having a gradually narrower diameter toward the inside from each of the upper surface and the lower surface of the core insulating layer 111, but it may not be limited thereto. The through via 130 may be formed of a conductive material such as, for example, copper.

The connection pattern 140 may be formed on the upper surface and the lower surface of the through via 130. The connection pattern 140 may be connected by the through via 130, so that the connection pattern 140 and the through via 130 are electrically connected.

The connection pattern 140 and the through via 130 are separately illustrated in FIG. 2 for the convenience of understanding. However, in an example, the connection pattern 140 and the through via 130 may be integrally formed at the same time. The connection pattern 140 may be formed of a conductive material such as, for example, copper.

The first coil pattern 120 may be formed on the upper surface and the lower surface of the core insulating layer 111. At least one of the first coil patterns 120 may adhere to the connection pattern 140 and be electrically connected with each other.

The second coil pattern 160 may be formed on the upper part of the first coil pattern 120. The second coil pattern 160 may adhere to the first coil pattern 120 to be electrically connected with each other. When each direction of the first coil pattern 120 and the second coil pattern 160 is specified, the direction from the first coil pattern 120 to the core insulating layer 111 is called as downward direction and the reverse direction as upward direction.

In an example, the second coil pattern 160 may be formed in multi layers. As shown in FIG. 2, 2 or more second coil patterns 160 may be laminated to adhere to each other. However, it may not be limited thereto, and the number of layers of the second coil pattern 160 may be selected as desired.

The upper surface of the first coil pattern 120 may be formed to have a greater diameter than the lower surface of the second coil pattern 160 to reduce a defective rate associated with misalignment, compared to when the upper surface of the first coil pattern 120 has the same diameter as the lower surface of the second coil pattern 160.

The upper surface of the second coil pattern 160 may be formed to have a greater diameter than the lower surface of the second coil pattern 160. The upper surface of the second coil pattern 160 may be formed to have a greater diameter than the lower surface of another second coil pattern 160, which is laminated thereon. Thus, a defective rate associated with misalignment of the laminated second coil patterns 160 may be reduced.

The first coil pattern 120 and the second coil pattern 160 may be formed of a conductive material such as, for example, copper.

The coil 191 may be formed by laminating the desired number of the second coil patterns 160 on the first coil pattern 120, such as a height A of the coil 191 may be increased. As the total height A of the coil 191 increases, total area of the coil 191 may increase. Accordingly, the inductor 100 may have improved properties by increasing the area of the coil 191.

As shown in FIG. 1, the coil 191 may be formed in a wound shape in a circle or polygon type from the inside to the outside. The coil 191 may all look separate as shown in FIG. 2 and FIG. 3 but they are all connected by being wound from the inside to the outside.

The insulating layer 192 may be formed on the upper part and the lower part of the core insulating layer 111. The insulating layer 192 may be formed to embed the coil 191 formed on the upper part and the lower part of the core insulating layer 111. The insulating layer 192 may include a first insulating layer 150 and a second insulating layer 170.

The insulating layer 192 may be formed on the upper part and the lower part of the core insulating layer 111 to embed the first coil pattern 120 and the second coil pattern 160. The first insulating layer 150 may be formed to expose the upper surface of the second coil pattern 160 to the outside of the first insulating layer 150. When the second coil pattern 160 is laminated in multilayers, the first insulating layer 150 may be formed to embed all second coil patterns 160, except the outmost layer of the second coil pattern 160.

The second insulating layer 170 may be formed on the upper part of the first insulating layer 150. When the second coil pattern 160 is laminated in multilayers, the second insulating layer 170 may be formed to embed the outmost layer of the second coil pattern 160. The second insulating layer 170 may be formed to expose the upper surface of the second coil pattern 160, which is formed on the outmost layer, to the outside of the second insulating layer 170.

The first insulating layer 150 and the second insulating layer 170 may be formed of a composite polymer resin or an epoxy resin such as, for example, prepreg, ABF (Ajinomoto Build up Film) and FR-4, BT (Bismaleimide Triazine). In another example, the first insulating layer 150 and the second insulating layer 170 may be formed of a photosensitive insulating material including a photosensitive material. However, it may not be limited thereto.

For convenience of understanding, the insulating layer 192 is divided into the first insulating layer 150 and the second insulating layer 170. For example, the second insulating layer 170 may be formed to embed the second coil pattern 160 in other layers in addition to the outmost layer of the second coil pattern 160. In another example, the second insulating layer 170 may be omitted, so that the first insulating layer 150 may be formed to embed the entire coil 191. In another example, the first insulating layer 150 may be omitted, so that the second insulating layer 170 may be formed to embed the entire coil 191. The first insulating layer 150 and the second insulating layer 170 may be formed of the same or different insulating material as desired.

The leadline 180 may be formed in the insulating layer 192. The leadline 180 may be also formed on the upper part and the lower part of the core insulating layer 111 to adhere to the coil 191 and thus be electrically connected with the coil 191. Here, current may be applied to at least one of the leadlines 180, which are formed on the upper part and the lower part of the core insulating layer 111 and current may be outputted from the other leadline 180. For example, when current is applied to the leadline 180 formed on the upper part of the core insulating layer 111, current may be outputted from the leadline 180 formed on the lower part of the core insulating layer 111 and vice versa.

The leadline 180 may be formed on the second insulating layer 170 to adhere to the second coil pattern 160, but it may not be limited thereto. That is, the leadline 180 may be formed anywhere if it is able to adhere to the coil 191 as desired.

The leadline 180 may be formed of a conductive material, such as, for example, copper.

The protection layer 193 may be formed on the upper part and the lower part of the coil 191 and the insulating layer 192. The protection layer 193 may be formed along the side surface of the through hole 196. The protection layer 193 may insulate the coil 191 and connection pattern 140 from the magnetic material layer 194. The protection layer 193 may be formed of any insulating material that is able to protect the coil 191. For example, it may be formed of a heat resisting coating material such as, for example, a solder resist.

As shown in FIGS. 2 and 3, the through hole 196 may be formed to pass through the core insulating layer 111 and the insulating layer 192. The through hole 196 may be formed along the side surface of the coil 191 and the connection pattern 140.

The magnetic material layer 194 may be formed on the upper part and the lower part of the protection layer 193 to fill the through hole 196.

The magnetic material layer 194 may include a metallic magnetic powder and an insulating resin. Other composition of the magnetic material layer 194 may be used without departing from the spirit and scope of the illustrative examples described. In an example, the metallic magnetic powder may be a material such as, for example, an alloy or a metal mixture including iron and at least one chosen from nickel, silicon, aluminum, and chromium. The insulating resin may be a material such as, for example, an epoxy, a polyimide, and a liquid crystalline polymer, but it may not be limited thereto. The insulating resin may be any resin if it is able to insulate between metallic magnetic powders.

The external electrode 195 may be formed on the external surface of the magnetic material layer 194. The external electrode 195 may adhere to the leadline 180. Since the external electrode 195 adheres to the leadline 180, the external electrode 195 and the coil 191 may be electrically connected with each other through the leadline 180.

The external electrode 195 may be formed of a conductive material such as, for example, copper, but it may not be limited thereto.

An example of an inductor 200 will be explained with reference to FIG. 1 and FIG. 4. The inductor 200 may include a core insulating layer 111, a through via 130, a coil 191, an insulating layer 192, a leadline 180, a protection layer 193, a magnetic material layer 194, and an external electrode 195.

The above descriptions of inductor 100, is also applicable to inductor 200, and is incorporated herein by reference. Thus, the above description of the inductor 100 may not be repeated here.

In the inductor 200, the upper surface and the lower surface of a second coil pattern 161 may have the same diameter. Here, 'the same diameter' means that the diameter of the upper surface and the lower surface is substantially equal to each other with consideration of errors and deviations, which can be caused during the manufacturing process.

Since the coil 191 is formed by laminating the second coil pattern 160 of which the upper surface and the lower surface have the same diameter, the side surface area of the coil 191 may be minimized. Thus, the inductor 200 may reduce DC resistance (Rdc) which may further reduce heat generation.

Figure 5:
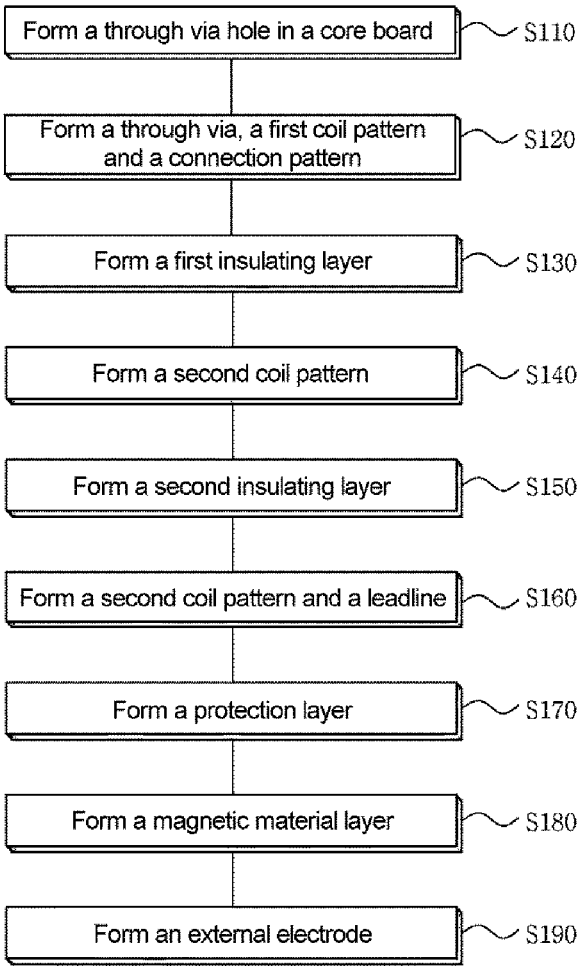
FIG. 5 is a diagram illustrating an example of a method for manufacturing an inductor.

FIG. 5 is a diagram illustrating an example of a method for manufacturing an inductor. FIG. 6 to FIG. 33 illustrate examples of a method for manufacturing an inductor e. The operations in FIG. 5 may be performed in the sequence and manner as shown, although the order of some operations may be changed or some of the operations omitted without departing from the spirit and scope of the illustrative examples described. Many of the operations shown in FIG. 5 may be performed in parallel or concurrently. The above descriptions of FIGS. 1-4, is also applicable to FIG. 5, and is incorporated herein by reference. Thus, the above description may not be repeated here. The diagram of FIG. 5 will be explained with reference to FIG. 6 to FIG. 33.

Figure 6:
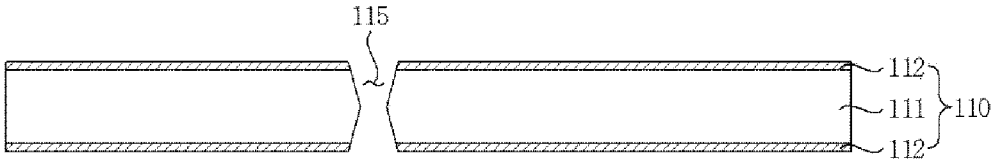
FIG. 6 to FIG. 33 are diagrams illustrating examples of a method for manufacturing an inductor.

In S110 of FIG. 5, referring to FIG. 6, a through via hole 115 may be formed in a core board 110.

The core board 110 may have a metal clad laminate structure including the core insulating layer 111 and core metal layers 112 formed on the upper part and the lower part of the core insulating layer 111.

The core insulating layer 111 may be formed of a composite polymer resin which is used as an insulating material, such as, for example, an epoxy resin such as prepreg, ABF (Ajinomoto Build up Film), FR-4, and BT (Bismaleimide Triazine).

The core metal layer 112 may be formed of a conductive material such as, for example, copper. Although an example of the core board 110 including the core metal layer 112 is described in the present example, other structure of the core board 110 are considered to be well within the scope of the present disclosure. For example, the core board 110 may be composed of the core insulating layer 111 without the core metal layer 112.

The through via hole 115 may be formed to pass through the core board 110. The via hole 115 may be formed using a drill, such as, for example, a CNC drill or a laser drill. The through via hole 115 may be formed by processing from each of the upper surface and the lower surface of the core board 110 to the inner-center. In another example, the through via hole 115 may be also formed by processing from one side of the core board 110 depending on thickness of the core board 110 or the processing method.

Figure 7:
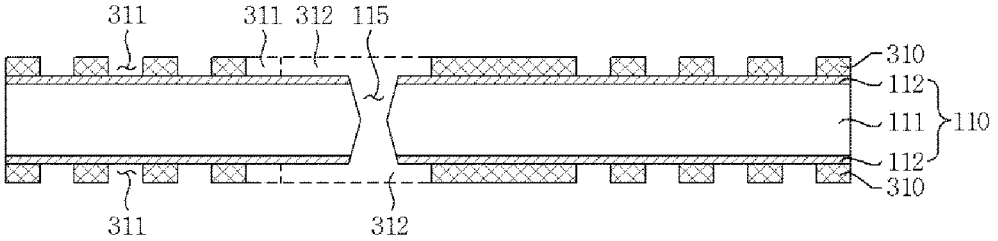

In S120 of FIG. 5, and in FIG. 7 to FIG. 10, a through via 130, a connection pattern 140, and a first coil pattern 120 may be then formed. Referring to FIG. 7, a plating resist 310 may be formed on each of the upper part and the lower part of the core board 110. The plating resist 310 may include a first plating opening part 311 and a second plating opening part 312. The first plating opening part 311 and the second plating opening part 312 may be formed to expose a part of the core board 110, where plating is to be performed, to the outside. That is, the first plating opening part 311 may be formed to expose the part of the core board 110, where a first coil pattern (not shown) is to be formed, and the second plating opening part 312 may be formed to expose the part of the core board 110, where the through via hole 115 and a connection pattern (not shown) are to be formed.

At least one of the first plating opening part 311 on the upper part and the lower part of the core board 110 may be connected with the second plating opening part 312.

Figure 8:
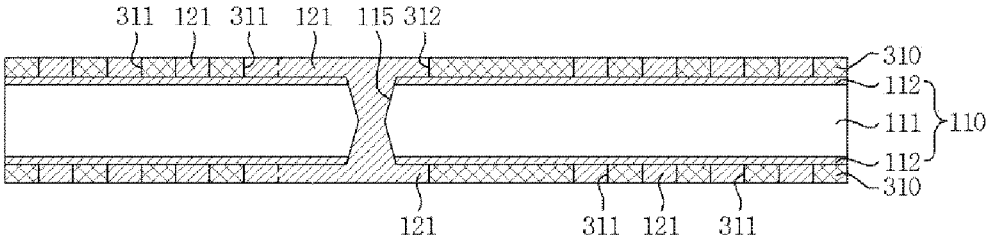

Referring to FIG. 8, a plating layer 121 may be formed on each of the upper part and the lower part of the core board 110. The plating layer 121 may be formed in the first plating opening part 311 and the second plating opening part 312 of the plating resist 310. In an example, the plating layer 121 may be formed using electro plating, where the core metal layer 112 may function as a seed layer.

In other examples, the plating layer 121 may be also formed by immersion plating or vapor deposition. The plating layer 121 may be formed of a conductive material such as, for example, copper.

The plating layer 121 may be formed in the through via hole 115 exposed by the second plating opening part 312 to fill inside the through via hole 115.

Figure 9:
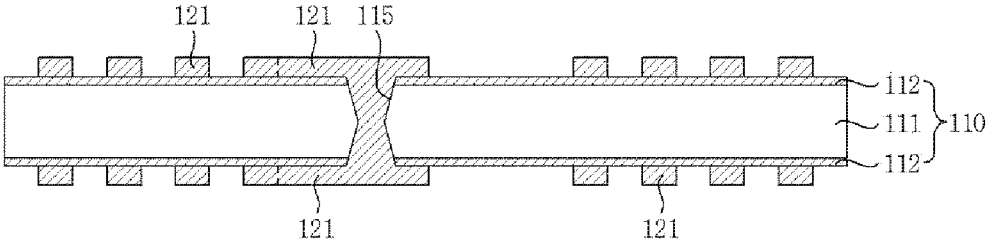

Referring to FIG. 9, the plating resist (310 in FIG. 8) may be eliminated. In an example, the plating resist may be eliminated using an alkali solution but it may not be limited thereto. A solution for eliminating the plating resist may vary with the kind of the plating resist material.

Figure 10:
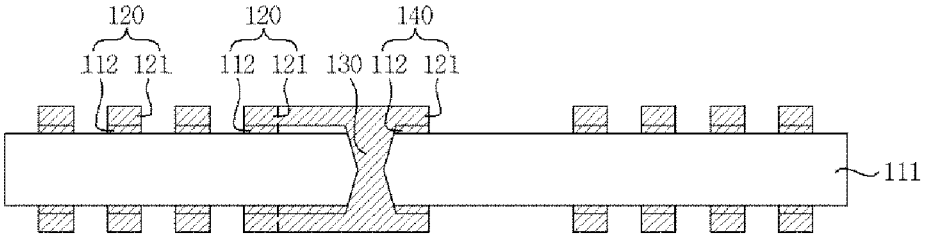

Referring to FIG. 10, the part of the core metal layer 112 which is exposed to the outside may be eliminated when the plating resist is eliminated. The core metal layer 112 may be eliminated using methods, such as, for example, quick etching or flash etching, but it may not be limited thereto.

The first coil pattern 120 may include the plating layer 121 and the core metal layer 112 formed on the first plating opening part (311 in FIG. 8). The connection pattern 140 may include the plating layer 121 formed on the second plating opening part (312 in FIG. 8), the plating layer 121 formed on the upper surface and the lower surface of the through via 130, and the core metal layer 112. The connection pattern 140 may adhere to and be electrically connected with the through via 130. The connection pattern 140 may be also adhere to and be electrically connected with the first coil pattern 120. At least one of more than one first coil pattern 120 in the upper part and the lower part of the core insulating layer 115 may adhere to and be electrically connected with the connection pattern 140.

A method for manufacturing core components will be explained based on the upper part of the core insulating layer 111 but it is apparent that the same process may be performed on the lower part. Therefore, the description of the method for manufacturing core components based on the upper part of the core insulating layer 111, is also applicable to the lower part of the core insulating layer 111, and is incorporated herein by reference. Thus, the above description may not be repeated here.

Figure 11:
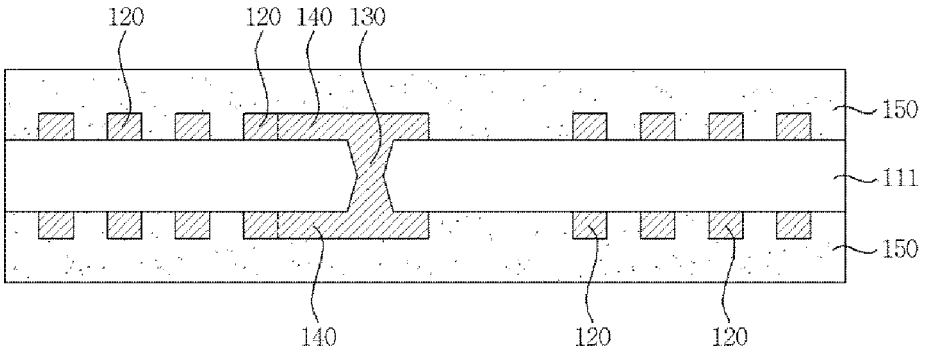

In S130 of FIG. 5, referring to FIG. 11, the first insulating layer 150 may be formed. The plating layer (121 in FIG. 10) and the core metal layer (112 in FIG. 10) are separately illustrated when the first coil pattern 120 and the connection pattern 140 are shown in FIG. 10. However, for convenience of explanation, they are not separately illustrated from FIG. 11.

The first insulating layer 150 may be formed on the upper part of the core insulating layer 111 to embed the first coil pattern 120 and the connection pattern 140.

The first insulating layer 150 may be formed by laminating an insulating film on the core insulating layer 111, the first coil pattern 120 and the connection pattern 140. The laminated insulating film may be compressed and heated. The first insulating layer 150 may be formed by coating an insulating material in a liquid on the upper part of the first coil pattern 120 and the connection pattern 140. The first insulating layer 150 may be formed of a composite polymer resin which is used as an insulating material, such as, for example, an epoxy resin such as prepreg, ABF (Ajinomoto Build up Film), and FR-4, BT (Bismaleimide Triazine). In another example, the first insulating layer 150 may be formed of a photosensitive insulating material. However, it may not be limited thereto.

Figure 12:
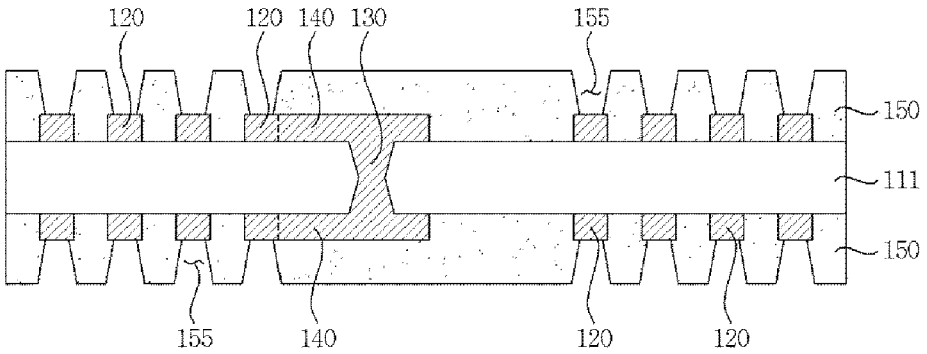
Figure 13:
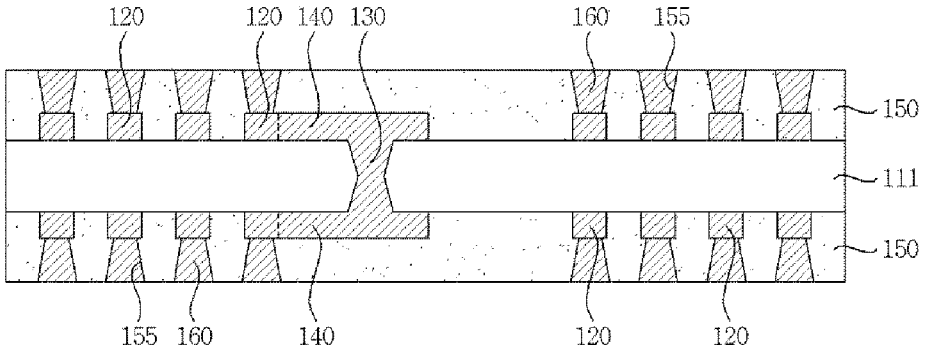

In S140 of FIG. 5, referring to FIG. 12 to FIG. 17, the second coil pattern 160 may be formed. Referring to FIG. 12 to FIG. 13, the second coil pattern 160 may be formed.

Referring to FIG. 12, a pattern hole 155 may be formed in the first insulating layer 150. The pattern hole 155 may be an opening part to form the second coil pattern 160 in the first insulating layer 150. The pattern hole 155 may be formed to pass through the first insulating layer 150 and expose the upper surface of the first coil pattern 120 to the outside.

The pattern hole 155 may be formed to have a greater diameter on the upper part than that on the lower part, which is closer to the core insulating layer 111. In an example, the minimum diameter of the pattern hole 155 may be smaller than that of the upper surface of the first coil pattern 120.

In an example, the pattern hole 155 may be formed using a laser drill.

Referring to FIG. 13, the second coil pattern 160 may be formed. The second coil pattern 160, formed in the first insulating layer 150, may be formed using electro plating, but it may not be limited thereto. The second coil pattern 160 may be formed by any method, which is known for forming vias or circuit patterns in the field of circuit boards.

The second coil pattern 160 may be formed of a conductive material such as, for example, copper. The second coil pattern 160 may be formed on the upper part of the first coil pattern 120. The second coil pattern 160 may adhere with the first coil pattern 120. Thus, the first coil pattern 120 and the second coil pattern 160 may be electrically connected with each other.

The upper surface of the second coil pattern 160 may be formed to have a greater diameter than the lower surface, and the lower surface of the second coil pattern 160 may be formed to have a smaller diameter than the upper surface of the first coil pattern 120. When the diameter of the lower surface of the second coil pattern 160 is lesser than that of the upper surface of the first coil pattern 120, it may reduce a defective rate caused for misalignment, compared to when the diameters of the both surfaces are the same.

Figure 14:
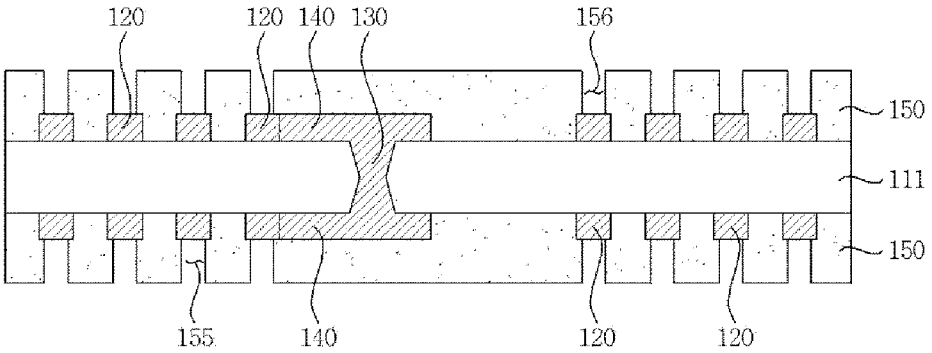
Figure 15:
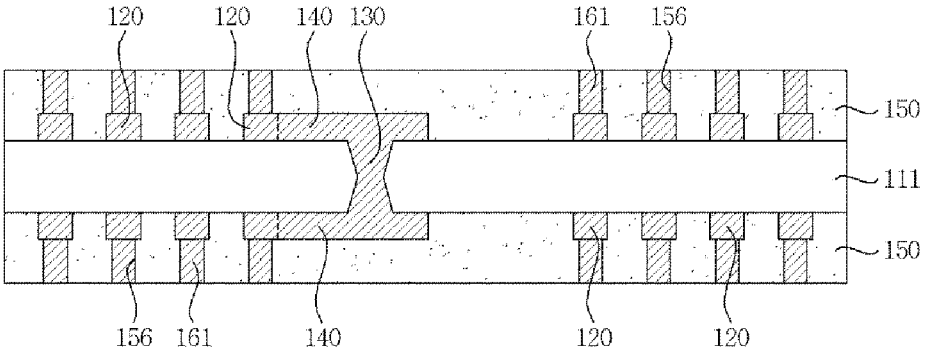

Referring to FIG. 14 and FIG. 15, a second coil pattern 161 may be formed.

In the description of a method for forming the second coil pattern 161, when it overlaps with the method for forming the second coil pattern 160 described above, the overlapping discussion will be omitted, but is incorporated herein by reference.

Referring to FIG. 14, a pattern hole 156 may be formed in the first insulating layer 150.

The first insulating layer 150 may be formed of a photosensitive material and the pattern hole 156 may be formed by an exposing process and a developing process.

The upper surface and the lower surface of the pattern hole 156 may have the same diameter. The cross section of the pattern hole 156 may be a quadrangle structure having the same diameter from the upper surface to the lower surface. Here, 'the same diameter' means that the diameter of the upper surface and the lower surface is substantially equal to each other with consideration of errors and deviations which can be caused during the manufacturing process. In addition, 'quadrangle' means a quadrangle with consideration of errors and deviations, which can be caused during the manufacturing process.

Referring to FIG. 15, a second coil pattern 161 may be formed.

The second coil pattern 161 may be formed by filling a conductive material into the pattern hole 156. Here, a method and a material for forming the second coil pattern 161 may be the same as those for forming the second coil pattern (160 in FIG. 13) described above, which is incorporated herein by reference. Thus, the above description may not be repeated here.

The second coil pattern 161 may have a quadrangle structure having the same diameter from the upper surface to the lower surface, so that DC resistance (Rdc) may be reduced, resulting in decrease in heat generation.

The pattern holes 155, 156 may be formed by process such as, for example, a laser drill or a photolithography process. The pattern holes 155, 156 may be formed by any method if it is able to form the cross sectional structure of the pattern holes 155, 156 *e*. For example, the pattern holes 155, 156 may be formed by a CNC drill in the first insulating layer 150.

Figure 16:
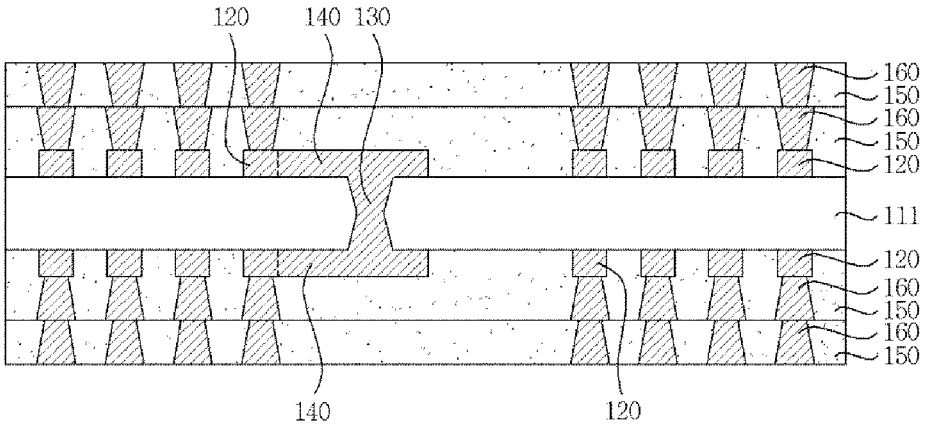

Referring to FIG. 16, a multilayered first insulating layer 150 and a multilayered second coil pattern 160 may be formed.

The multilayered first insulating layer 150 and the multilayered second coil pattern 160 may be formed by repeating the process from FIG. 11 to FIG. 13 as desired.

According to an example, the upper surface of the second coil pattern 160 may be formed to have a greater diameter than the lower surface thereof, such that even though the second coil pattern 160 is formed on the first insulating layer 150 in multilayers, a defective rate caused by misalignment may be reduced.

Figure 17:
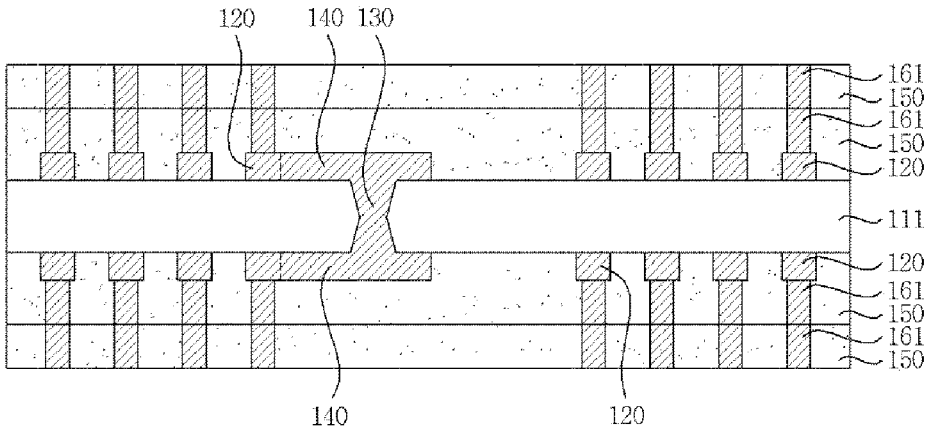
Figure 18:
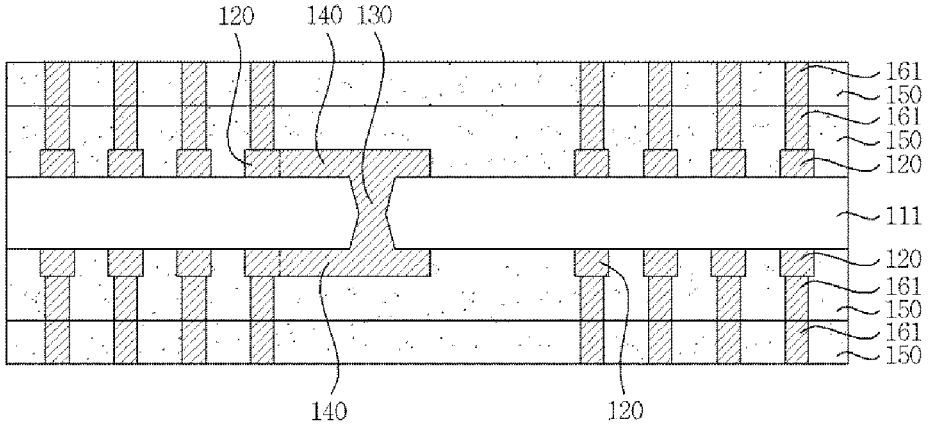

Referring to FIG. 17, a multilayered first insulating layer 150 and a multilayered second coil pattern 161 may be formed.

The multilayered first insulating layer 150 and the multilayered second coil pattern 161 may be formed by repeating the process from FIG. 11, FIG. 14 and FIG. 15 as desired.

According to another example, the upper surface and the lower surface of the second coil pattern 160 may be formed to be same, such that even though the second coil pattern 161 is formed on the first insulating layer 150 in multilayers, the side surface of the second coil pattern 161 may be formed uniformly. Accordingly, DC resistance (Rdc) may be reduced, resulting in decrease in heat generation.

Figure 19:
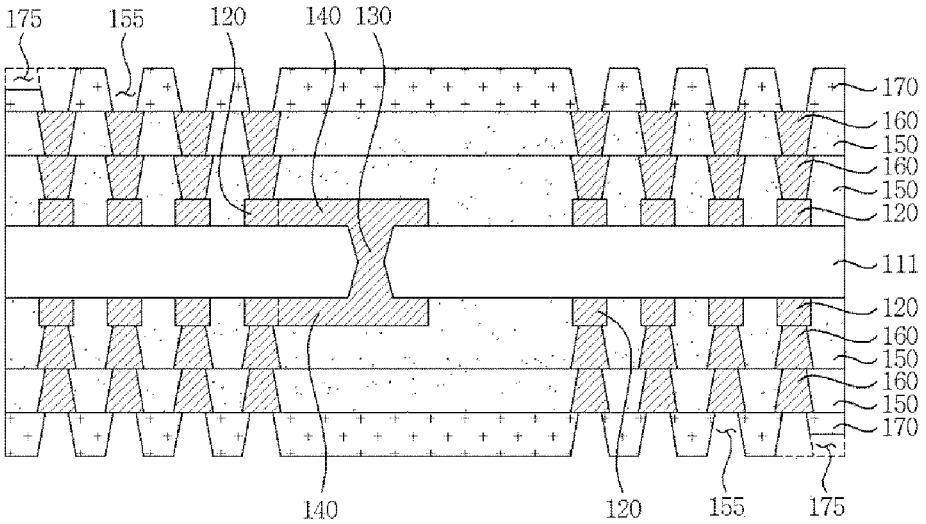

In S150 of FIG. 5, referring to FIG. 19, a second insulating layer 170 may be formed. The second insulating layer 170 may be formed on the upper part of the first insulating layer 150.

The second insulating layer 170 may be formed by laminating an insulating film on the first insulating layer 150 and the second coil pattern 160 and compressing and heating the laminated film. In another example, the second insulating layer 170 may be formed by coating an insulating material in a liquid form on the upper part of the first insulating layer 150 and the second coil pattern 160.

The second insulating layer 170 may be formed of a composite polymer resin. For example, the second insulating layer 170 may be formed of an epoxy resin such as, for example, prepreg, ABF (Ajinomoto Build up Film), FR-4, and BT (Bismaleimide Triazine). In another example, the second insulating layer 170 may be formed of a photosensitive insulating material. However, it may not be limited thereto.

The insulating layer formed on the outmost layer is referred to as a second the insulating layer 170 and distinguished from the first insulating layer 150 for the convenience of understanding of the present disclosure. That is, the second the insulating layer 170 may be formed of the same material and by the same method as the first the insulating layer 150.

Figure 20:
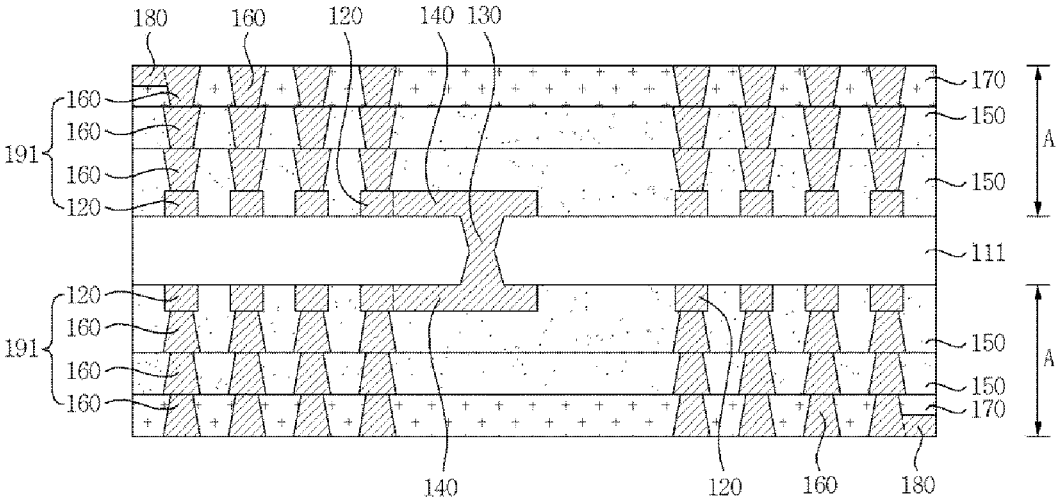

In S160 of FIG. 5, referring to FIG. 19 and FIG. 20, the second coil pattern 160 and the leadline 180 may be formed.

Referring to FIG. 19, the pattern hole 155 and the leadline opening part 175 may be formed in the second insulating layer 170. The pattern hole 155 may a pattern hole where the second coil pattern 160 is to be formed. The leadline opening part 175 may be formed in the second insulating layer 170 where a leadline (not shown) is to be formed.

Since the pattern hole 155 passes through the second insulating layer 170, the upper surface of the second coil pattern 160 formed on the first insulating layer 150 may be exposed to the outside. In an example, the upper part of the pattern hole 155 may be formed to have a greater diameter than the lower part thereof. The minimum diameter of the pattern hole 155 formed in the second insulating layer 170 may be smaller than that of the upper surface of the second coil pattern 160 formed on the first insulating layer 150.

The leadline opening part 175 may be formed in a shape of groove at a part of the second insulating layer 170, but its shape may not be limited thereto. It may be formed in a shape to pass through the second insulating layer 170. The leadline opening part 175 may be connected with at least one of more than one pattern hole 155.

In an example, the pattern hole 155 and the leadline opening part 175 may be formed using a laser drill. In another example, when the second insulating layer 170 is formed of a photosensitive insulating material, the pattern hole 155 and the leadline opening part 175 may be formed by an exposing process and a developing process.

Referring to FIG. 20, the second coil pattern 160 and the leadline 180 may be formed.

The second coil pattern 160 may be formed by filling a conductive material into the pattern hole (155 of FIG. 19) formed in the second insulating layer 170. The leadline 180 may be formed by filling a conductive material into the leadline opening part (175 of FIG. 19).

The second coil pattern 160 and the leadline 180 formed in the second insulating layer 170 may be formed using electro plating. The leadline 180 may be formed using a plating process using a dummy pattern (not shown) without forming a seed layer. That is, an immersion plating process may be omitted to form the leadline 180. However, the method forming the second coil pattern 160 and the leadline 180 may not limited thereto. The second coil pattern 160 and the leadline 180 may be thus formed by any method, which is known for forming vias or circuit patterns in the field of circuit boards.

The second coil pattern 160 and the leadline 180 formed in the second insulating layer 170 may be formed of a conductive material such as, for example copper. Since at least one of more than one pattern hole (155 of FIG. 19) is connected with the leadline opening part (175 of FIG. 19), the at least one of more than one pattern hole may be adhere to and be electrically connected with the leadline 180. At least one of more than one leadline 180 formed on the upper part and the lower part of the core insulating layer 111 may be used as a terminal to input current and the other leadline 180 may be used to output current.

The first insulating layer 150 and the second coil pattern 160 formed in the second insulating layer 170 may be laminated to adhere to and be electrically connected with each other.

The lower surface of the second coil pattern 160 formed in the second insulating layer 170 may be formed to have a smaller diameter than the upper surface of the second coil pattern 160 formed on the first insulating layer 150. Thus, a defective rate caused by misalignment between the first insulating layer 150 and the second coil pattern 160 formed in the second insulating layer 170 may be reduced.

The coil 191 may be formed on each of the upper part and the lower part of the core insulating layer 111 through the process from FIG. 6 to FIG. 20.

The coil 191 may be formed to have various heights by controlling the number of layers of the second coil pattern 160 which is formed on the first coil pattern 120. In addition, when the coil 191 is formed, a defective rate caused by uneven growth of plating may be reduced since the coil is not formed by one time plating but laminating more than one second coil pattern 160 on the first coil pattern 120. For example, a defective rate such as limitation on height and shorts between coils caused for uneven growth of plating may be reduced.

Furthermore, circuit patterns (coils) may be formed after forming the insulating layer, such that defects caused due to inflow of metal materials between coils may be reduced, compared to when the coil is formed by using a conventional plating process. As a result, a process for eliminating the metal materials flowed in the coils may be omitted.

Figure 21:
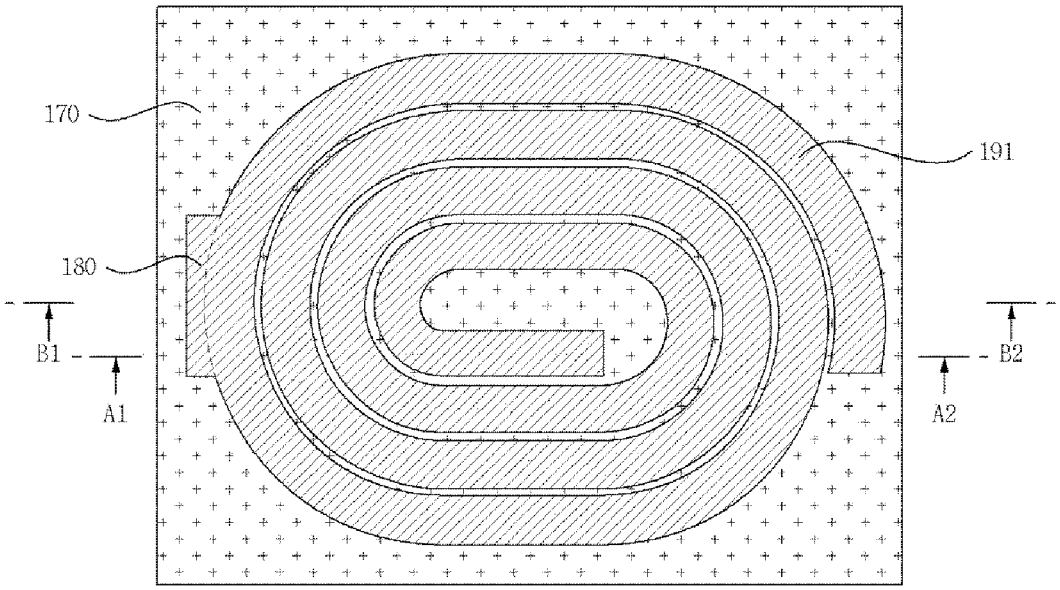

FIG. 21 is a diagram illustrating an example of a plan view of FIG. 20.

The coil 191 is separately illustrated in FIG. 20 but is all connected by being wound from the inside to the outside as shown in FIG. 21. Since a plurality of the first coil patterns 120 are formed on the first insulating layer 150, it may all look separate but it is one pattern as shown in FIG. 21. The second coil pattern 160 is the same as well.

The coil 191 may be formed by being wound in a circle on each of the upper part and the lower part of the core insulating layer (111 of FIG. 20).

Figure 22:
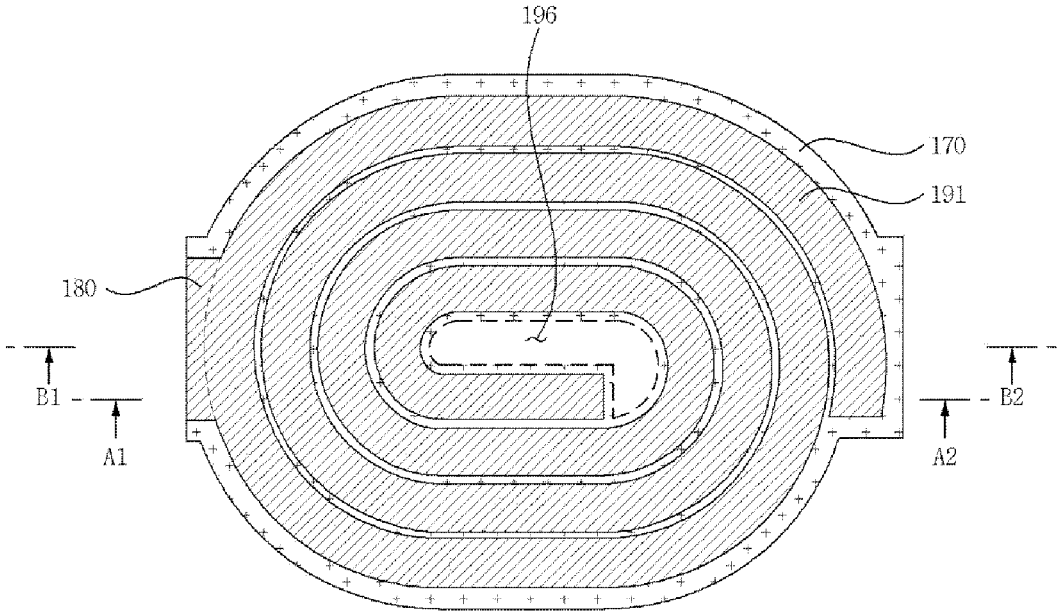
Figure 23:
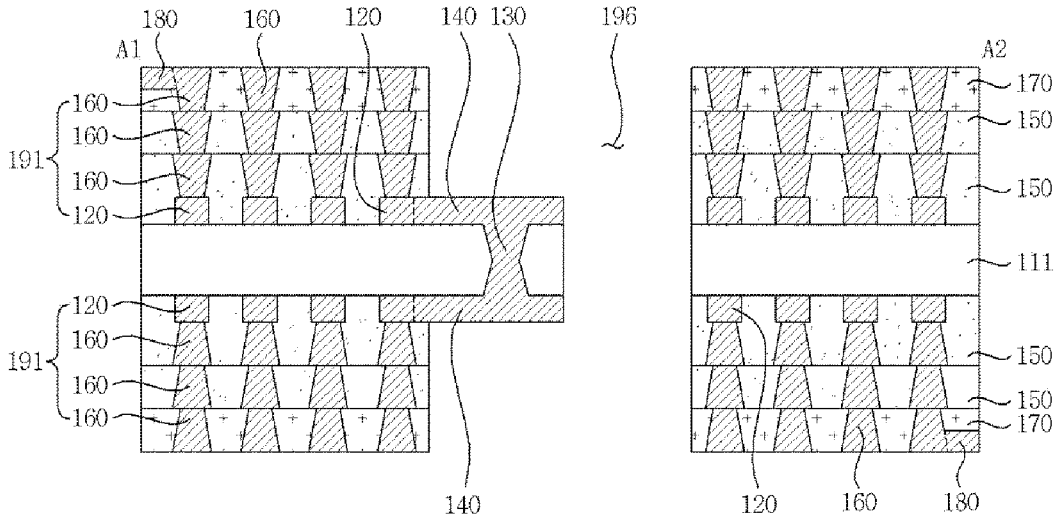
Figure 24:
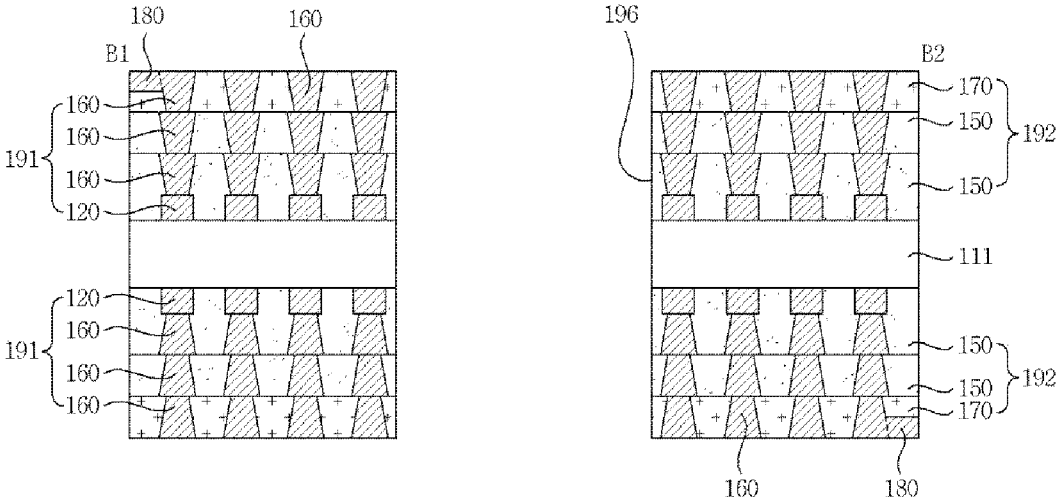

Referring to FIG. 22 to FIG. 24, a through hole 196 may be formed in the core insulating layer 111 and the insulating layer 192. FIG. 23 is an example of an A1-A2 sectional view of FIG. 22 and FIG. 24 is an example of a B1-B2 sectional view of FIG. 22.

The through hole 196 may be formed to pass through the core insulating layer 111, the first insulating layer 150 and the second insulating layer 170 inside the coil 191. The through hole 196 may be formed to expose a part of the connection pattern 140. For example, as shown in FIG. 23, the through hole 196 may be formed along the side surface of the coil 191 and the connection pattern 140 and to expose the side surface and a part of the upper surface of the connection pattern 140. The through hole 196 may be formed by a process such as, for example, by a laser drill.

When the through hole 196 is formed, any unnecessary part among the core insulating layer 111, the first insulating layer 150 and the second insulating layer 170 may be eliminated at the same time.

Figure 25:
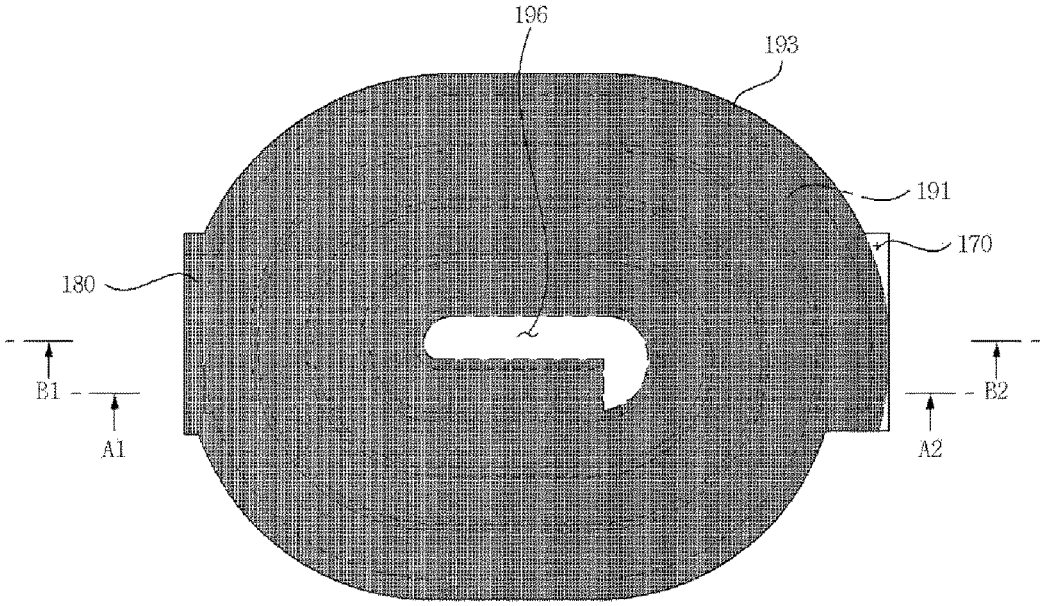
Figure 26:
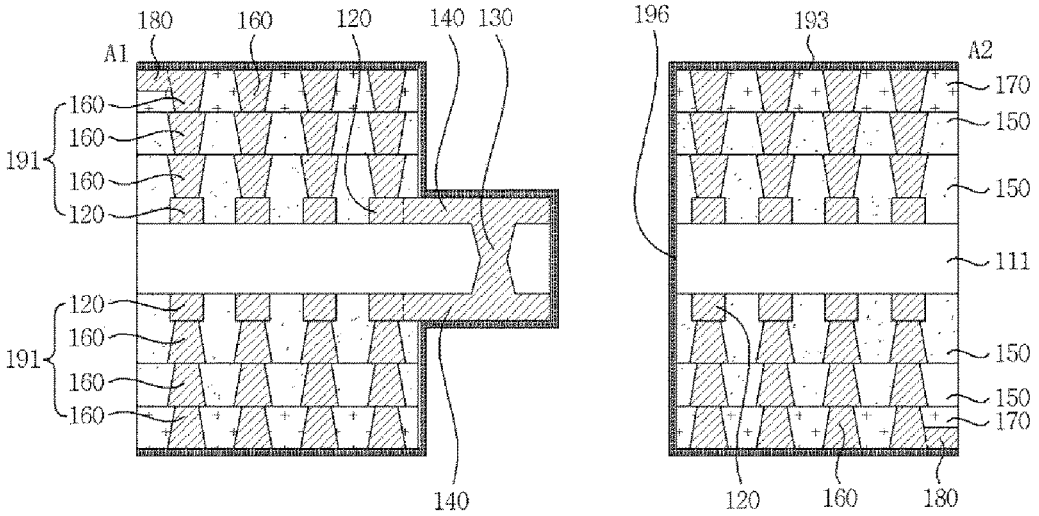
Figure 27:
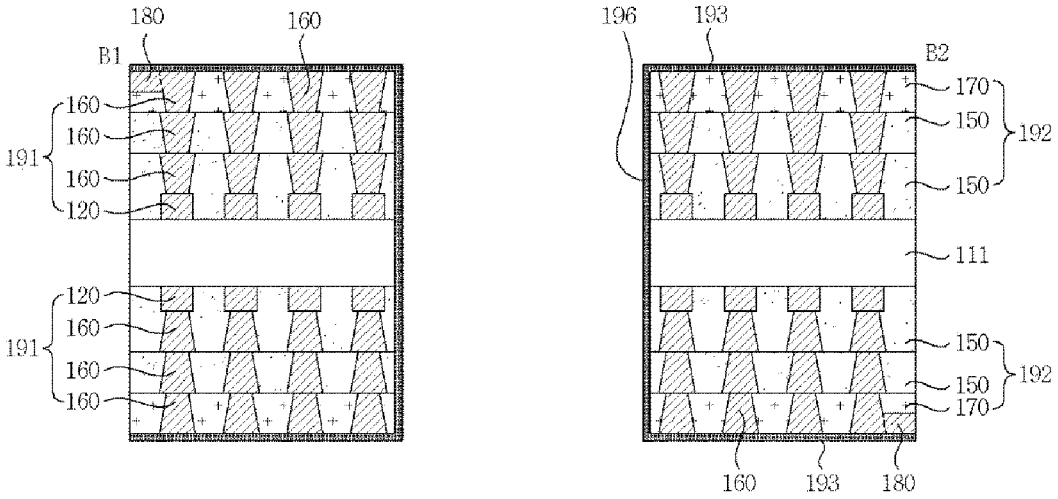

In S170 of FIG. 5, referring to FIG. 25 to FIG. 27, a protection layer 193 may be formed.

In an example, the protection layer 193 may be formed on the upper part and the lower part of the coil 191 and the inner side surface of the through hole 196. Thus, the protection layer 193 may be formed to cover the exposed coil 191 and the connection pattern 140. The protection layer 193 may insulate the coil 191 and the connection pattern 140 from a magnetic material layer (not shown) that is to be formed later. The protection layer 193 may be formed of any insulating material which is known to protect the coil in the field of circuit boards or inductors. The protection layer 193 may be also formed of a heat resisting coating material such as, for example, a solder resist.

The protection layer 193 may be formed to completely cover the coil 191 as shown in FIG. 25 to FIG. 27. The protection layer 193 may be also formed to selectively cover the upper surface and the lower surface of the coil 191. When the protection layer 193 is formed only on the upper surface and the lower surface of the coil 191, the through hole 196 may be extended to the protection layer 193.

Figure 28:
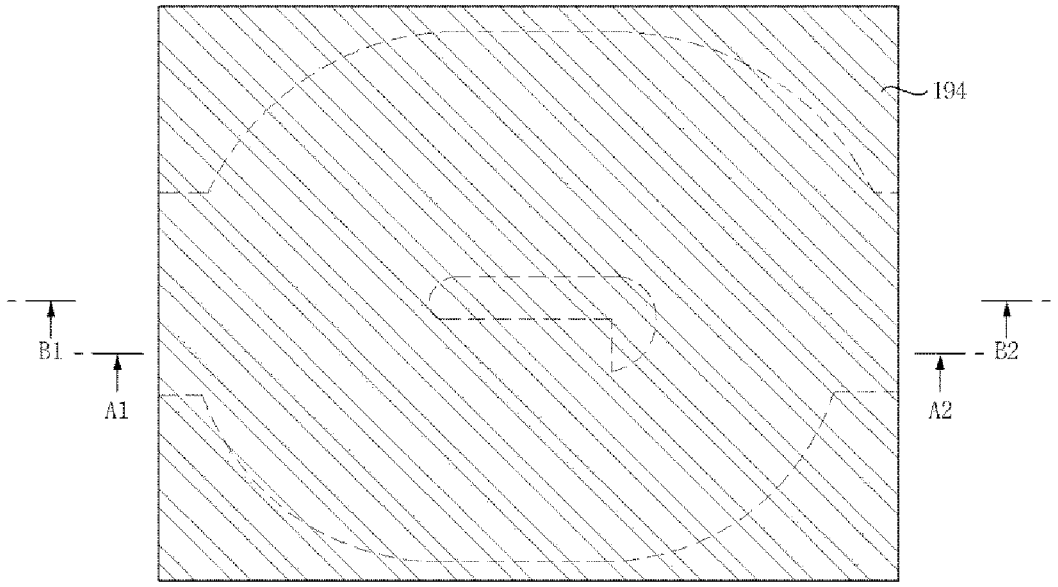
Figure 29:
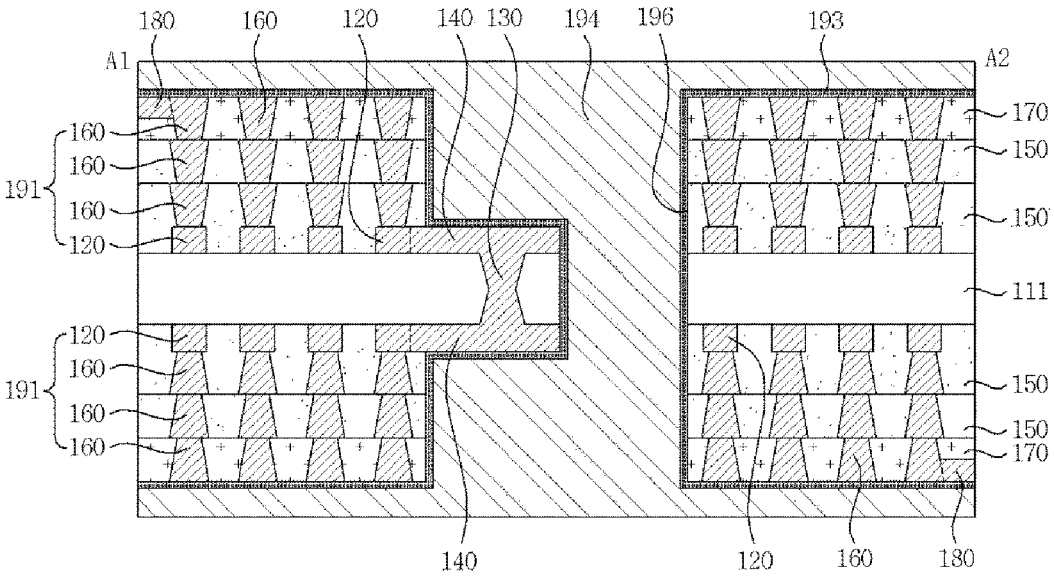
Figure 30:
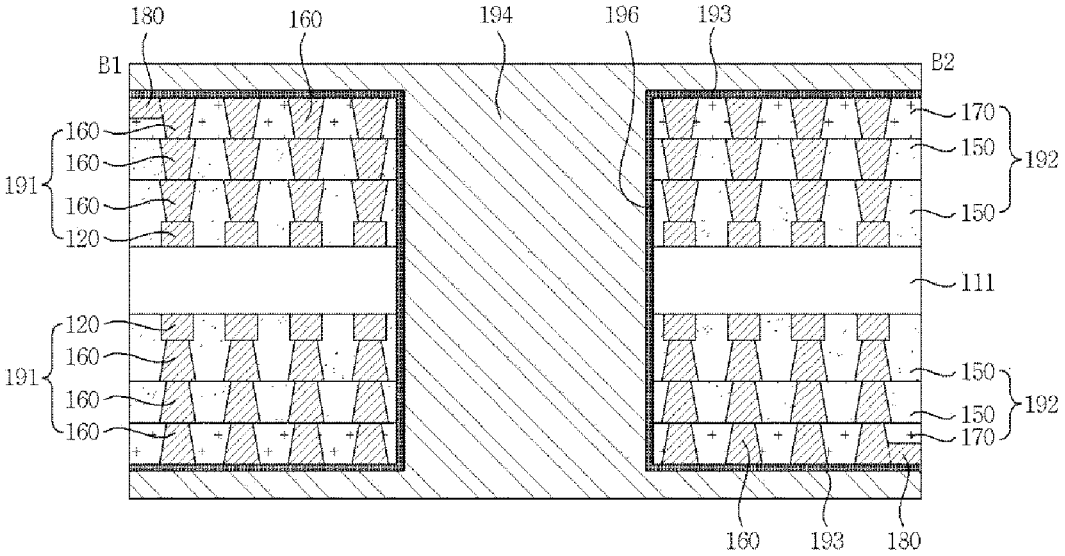

In S180 of FIG. 5, referring to FIG. 28 to FIG. 30, the magnetic material layer 194 may be formed on the coil 191.

The magnetic material layer 194 may include metallic magnetic powder and an insulating resin. The magnetic material layer 194 may be formed through laminating, compressing, and hardening processes on the coil 191 to embed the coil 191. The magnetic material layer 194 may be formed to fill the through hole 196.

The metallic magnetic powder may be an alloy or a metal mixture including iron and at least one of nickel, silicon, aluminum, or chromium. However, Other compositions of the magnetic powder may be used without departing from the spirit and scope of the illustrative examples described. The insulating resin may include at least one chosen from an epoxy, a polyimide or a liquid crystalline polymer, but it may not be limited thereto.

In another example, the magnetic material layer 194 may be formed by laminating a magnetic sheet on the coil 191 and compressing the laminated magnetic sheet. However, the method for forming the magnetic material layer 194 may not be limited thereto. Thus, in yet another example, the magnetic material layer 194 may be also formed to embed the coil 191 by applying paste of a magnetic material. Here, the leadline 180 may be exposed to the outside through the side of the magnetic material layer 194.

The magnetic material layer 194 may be insulated from the coil 191 and the connection pattern 140 by the protection layer 193.

Figure 31:
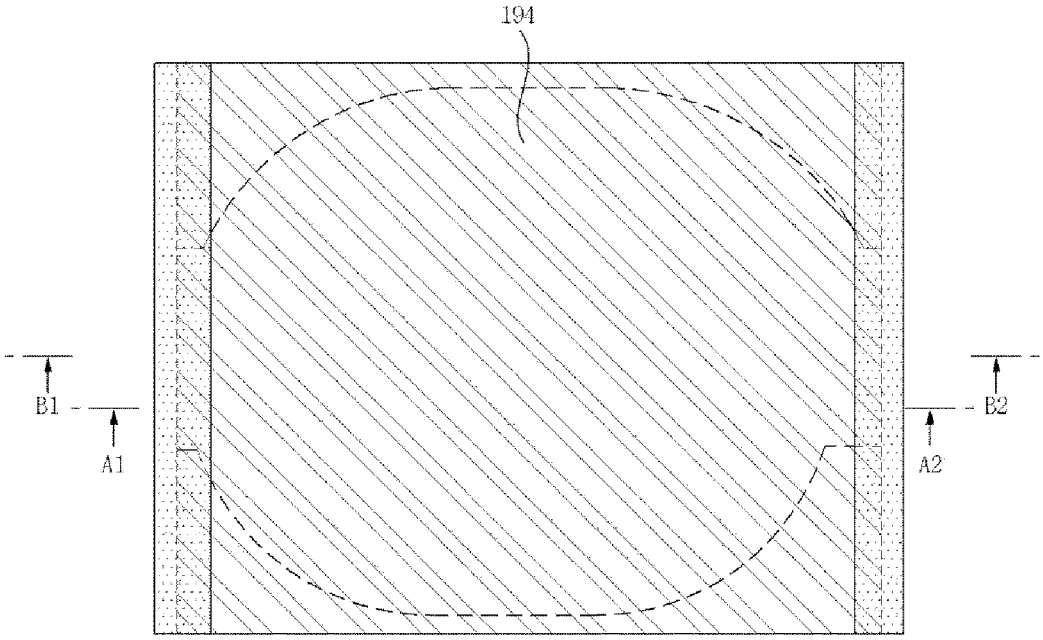
Figure 32:
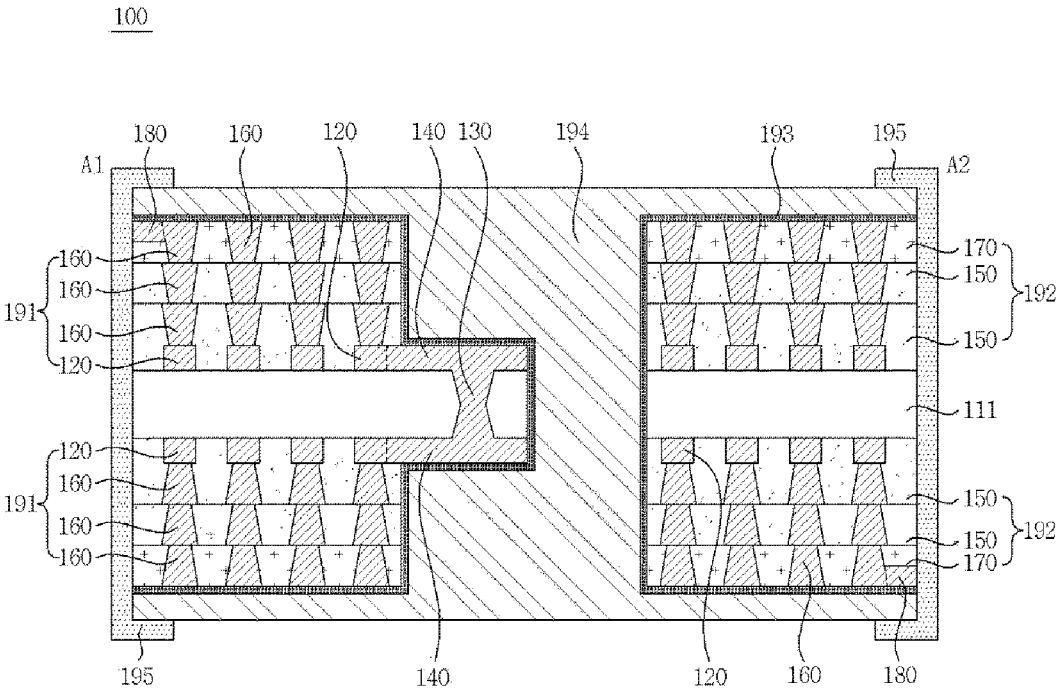
Figure 33:
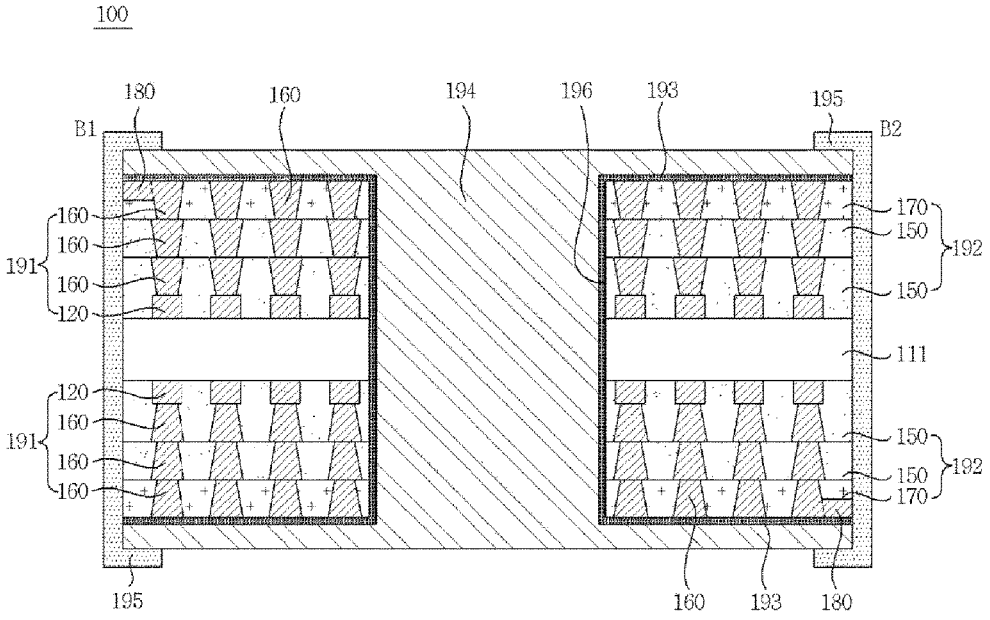

In S190 of FIG. 5, referring to FIG. 31 to FIG. 33, the external electrode 195 may be formed.

The external electrode 195 may be formed on the side surface of the magnetic material layer 194. The external electrode 195 may be formed to cover the leadline 180 which is exposed to the outside on the side surface of the magnetic material layer 194. Thus, the external electrode 195 and the leadline 180 may adhere to and be electrically connected with each other. As a result, the coil 191 inside the magnetic material layer 194 and the external electrode 195 may be electrically connected with each other.

The external electrode 195 may be formed by plating the side surface of the magnetic material layer 194 with a metallic material, such as, for example copper. Accordingly, the external electrode 195 may be formed by plating with any conductive material. Furthermore, the method for forming the external electrode 195 may not be limited to the plating. In other examples, the external electrode 195 may be thus formed by printing or depositing a conductive material and sputtering.

The external electrode 195 may be formed in a single layer but it may not be limited thereto. The external electrode 195 may be also formed in multilayers using different materials in each layer.

In the example described above, the external electrode 195 has been manufactured using the steps from FIG. 22 to FIG. 33, but the order of some operations may be changed or some of the operations omitted without departing from the spirit and scope of the illustrative examples described.

In an example, the inductor 100 and the inductor 200 may be formed according to the diagram illustrated in FIG. 3 and the method from FIG. 6 to FIG. 33.

According to the method for manufacturing the inductor 100 and the inductor 200, a height A of the coil 191 may vary with the number of layers of the second coil patterns 160, 161. As the total height A of the coil 191 increases, total area of the coil 191 may increase. Accordingly, the inductor 100 and the inductor 200 may have improved properties such as impedance by increasing the area of the coil 191.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

DESCRIPTION OF REFERENCE NUMERALS

100, 200: Inductor
110: Core board
111: Core insulating layer
112: Core metal layer
115: Through via hole
120: First coil pattern
121: Plating layer
130: Through via
140: Connection pattern
150: First insulating layer
155, 156: Pattern hole
160, 161: Second coil pattern
170: Second insulating layer
175: Leadline opening part
180: Leadline
191: Coil
192: Insulating layer
193: Protection layer
194: Magnetic material layer
195: External electrode
196: Through hole
310: Plating resist
311: First plating opening part
312: Second plating opening part
A: Height

What is claimed is:

1. An inductor comprising:

a core insulating layer;

a coil comprising an upper coil part formed on an upper part of the core insulating layer, a lower coil part formed on a lower part of the core insulating layer, and a through via configured to electrically connect the upper coil part and the lower coil part at a circumferential interior region of the coil; and an insulating layer formed on the upper part and the lower part of the core insulating layer, the coil being embedded in the insulating layer, wherein the upper coil part and the lower coil part each comprise a first coil pattern formed on the core insulating layer and embedded in the insulating layer, and a second coil pattern formed in a pattern hole penetrating the insulating layer so as to expose an upper surface of the first coil pattern, wherein a diameter of the pattern hole continuously increases from a lower end of the pattern hole to an upper end of the pattern hole.

2. The inductor of claim 1, further comprising leadlines embedded in the insulating layer to adhere to the coil.

3. The inductor of claim 2, wherein the leadlines are formed on each of the upper part and the lower part of the core insulating layer.

4. The inductor of claim 1, further comprising a connection pattern formed on an upper surface and a lower surface of the through via to adhere to the upper coil part and the lower coil part.

5. The inductor of claim 1, further comprising a magnetic material layer embedded on the insulating layer and the coil.

6. The inductor of claim 5, further comprising an external electrode configured to cover a part of the magnetic material layer and to be electrically connected with the coil.

7. The inductor of claim 1, wherein the second coil pattern comprises more than one layer.

8. The inductor of claim 1, wherein the through via is formed in a hourglass shape, and a diameter of the through via at the upper part is greater than a diameter of the through via at a point between the upper part and the lower part.

9. The inductor of claim 1, wherein the through via is formed in a hourglass shape, and a diameter of the through via at the lower part is greater than a diameter of the through via at a point between the upper part and the lower part.

10. The inductor of claim 1, wherein the diameter of the through via decreases from the lower part and the upper part to a point between the upper part and the lower part.

11. The inductor of claim 1, wherein a diameter of a lower surface of the second coil pattern is smaller than a diameter of the upper surface of the first coil pattern, and a diameter of an upper surface of the second coil pattern is greater than the diameter of the lower surface of the second coil pattern.

12. The inductor of claim 1, wherein a diameter of the second coil pattern continuously increases from a lower surface of the second coil pattern to an upper surface of the second coil pattern.

13. The inductor of claim 1, wherein the through via is located at an innermost circumferential portion of the coil.

14. The inductor of claim 1, further comprising:

a magnetic material layer; and a protection layer formed to cover the coil and the insulating layer, and to isolate the coil and the insulating layer from the magnetic material layer.

15. The inductor of claim 13, wherein a first end of a protection layer and a second end of the protection layer abut an electrode of the inductor.

* * * * *